US005831227A

United States Patent [19]

Finn et al.

[11] Patent Number: 5,831,227

[45] Date of Patent: Nov. 3, 1998

[54] DIFFERENTIAL MAGNETIC ALIGNMENT OF AN ELEVATOR AND A LANDING

[75] Inventors: Alan M. Finn, Amston, Conn.; Jean-Noel Cloux, Lex Choux, France; Peter L. Herkel, Berlin, Germany; Jean-Pierre Pougny, Saint Godon; Helmut L. Schröder-Brumloop, Ville d'Auray, both of France; Armando Servia, Madrid, Spain; Hans-Kilian Josef Spielbauer, Berlin, Germany

[73] Assignee: Otis Elevator Company, Farmington, Conn.

[21] Appl. No.: 766,922

[22] Filed: Dec. 13, 1996

[51] Int. Cl.[6] ..... B66B 1/34; B66B 3/00

[52] U.S. Cl. ..... 187/394; 187/390; 187/291

[58] Field of Search ..... 187/390, 393, 187/394, 283, 282, 291

[56] References Cited

U.S. PATENT DOCUMENTS

| | | | |
|---|---|---|---|
| 1,561,232 | 11/1925 | Higbee . | |
| 1,680,675 | 8/1928 | Gale . | |
| 1,909,094 | 5/1933 | Claytor . | |
| 1,961,133 | 6/1934 | Brown | 187/29 |
| 2,255,526 | 9/1941 | Lassen | 187/29 |
| 3,048,818 | 8/1962 | Buckhard et al. | 187/394 |
| 3,889,231 | 6/1975 | Toasato et al. | 187/394 |
| 3,983,961 | 10/1976 | Aron | 187/291 |
| 4,203,506 | 5/1980 | Richmon | 187/29 |
| 5,410,149 | 4/1995 | Winston, Jr. et al. | 250/221 |
| 5,509,505 | 4/1996 | Steger et al. | 187/394 |
| 5,677,519 | 10/1997 | Herkel et al. | 187/291 |

FOREIGN PATENT DOCUMENTS

| | | | |
|---|---|---|---|
| 245757 | 3/1966 | Austria | 187/394 |

*Primary Examiner*—Robert E. Nappi

[57] ABSTRACT

An apparatus for determining if an elevator car is level with respect to a landing comprises: a first magnet disposed proximate to the landing; a second magnet disposed proximate to the landing; a sensor for providing a level signal in response to detecting a minimum flux region formed by the first and second magnets; and a processor for determining if the elevator is level with respect to the landing in response to the level signal. Each magnet has a first and second magnetic pole. The first and second magnets are adjacently aligned such that the first magnetic pole of the first magnet is adjacent to the first magnetic pole of the second magnet, and the second magnetic pole of the first magnet is adjacent to the second magnetic pole of the second magnet.

3 Claims, 2 Drawing Sheets

DIFFERENTIAL MAGNETIC ALIGNMENT OF AN ELEVATOR AND A LANDING

TECHNICAL FIELD

The present invention relates generally to elevators and, in particular, relates to alignment of an car and a landing.

BACKGROUND OF THE INVENTION

To stop an elevator smoothly and level with a landing, an elevator system must know when to initiate a stop, when to go into a leveling mode of operation, and when to begin opening the landing doors. It is therefore necessary to know the exact location of the elevator car with respect to the landing. As a consequence, elevator leveling devices are used to determine if the elevator car is level with respect to the landing.

One existing elevator leveling device includes one magnet disposed proximate to the landing so that as the elevator travels in a hoistway a magnetic field associated with the magnet is detected by the elevator system. Once the magnetic field is detected, the elevator system determines that the elevator car is level with respect to the landing.

Other techniques for determining if an elevator car is level with respect to the landing are sought, and it is to this end that the present invention is directed.

DISCLOSURE OF THE INVENTION

It is an object of the present invention to provide improved leveling of an elevator car with respect to a landing.

According to the present invention, an apparatus for determining if an elevator car is level with respect to a landing comprises: a first magnet disposed proximate to the landing; a second magnet disposed proximate to the landing; a sensor for providing a level signal in response to detecting a minimum flux region formed by the first and second magnets; and a processor for determining if the elevator is level with respect to the landing in response to the level signal. Each magnet has a first and second magnetic pole. The first and second magnets are adjacently aligned such that the first magnetic pole of the first magnet is adjacent to the first magnetic pole of the second magnet, and the second magnetic pole of the first magnet is adjacent to the second magnetic pole of the second magnet.

BEST MODE FOR CARRYING OUT THE INVENTION

Figure 1:
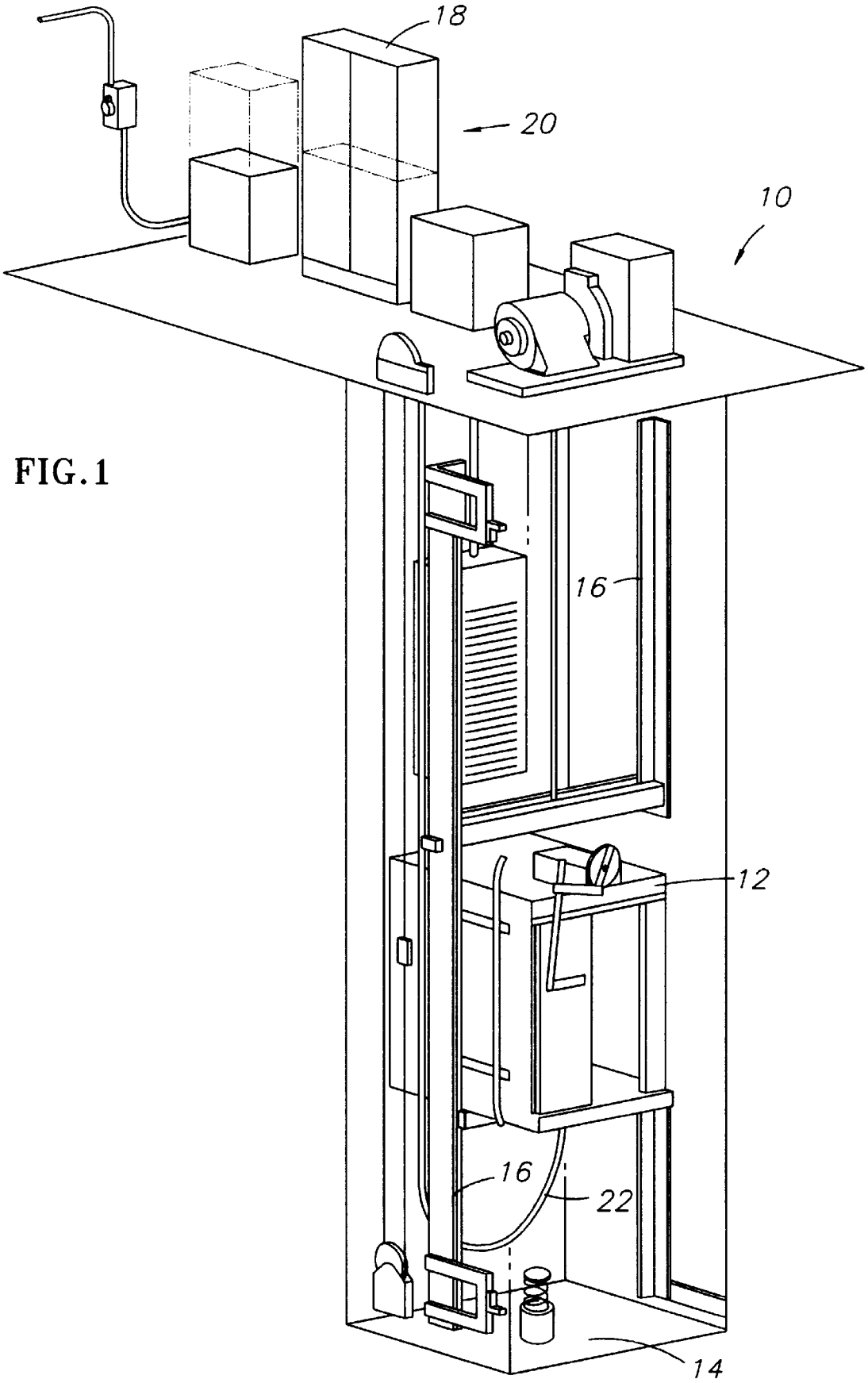
FIG. 1 is a perspective view of an elevator system in a building.

Referring to FIG. 1, an elevator system 10 in a building is shown. An elevator car 12 is disposed in a hoistway 14 such that the elevator car 12 travels in a longitudinal direction along elevator guide rails 16 in the hoistway 14. An elevator controller 18 is disposed in a machine room 20 which monitors and provides system control of the elevator system 10. A traveling cable 22 is used to provide an electrical connection between the elevator controller 16 and electrical equipment in the hoistway 14. Of course, it should be realized that the present invention can be used in conjunction with other elevator systems including hydraulic and linear motor systems, among others. Additionally, one of ordinary skill in the art would recognize that the present invention also can be used in conjunction with horizontal people mover systems.

In a preferred embodiment, the present invention operates in conjunction with an approximate position transducer such as, but not limited to, a governor shaft encoder or a motor shaft encoder. These types of transducers are well known to one of ordinary skill in the art. The approximate position transducer provides an approximate position signal which is processed to assist in leveling the elevator with the landing as is described below.

Figure 2:
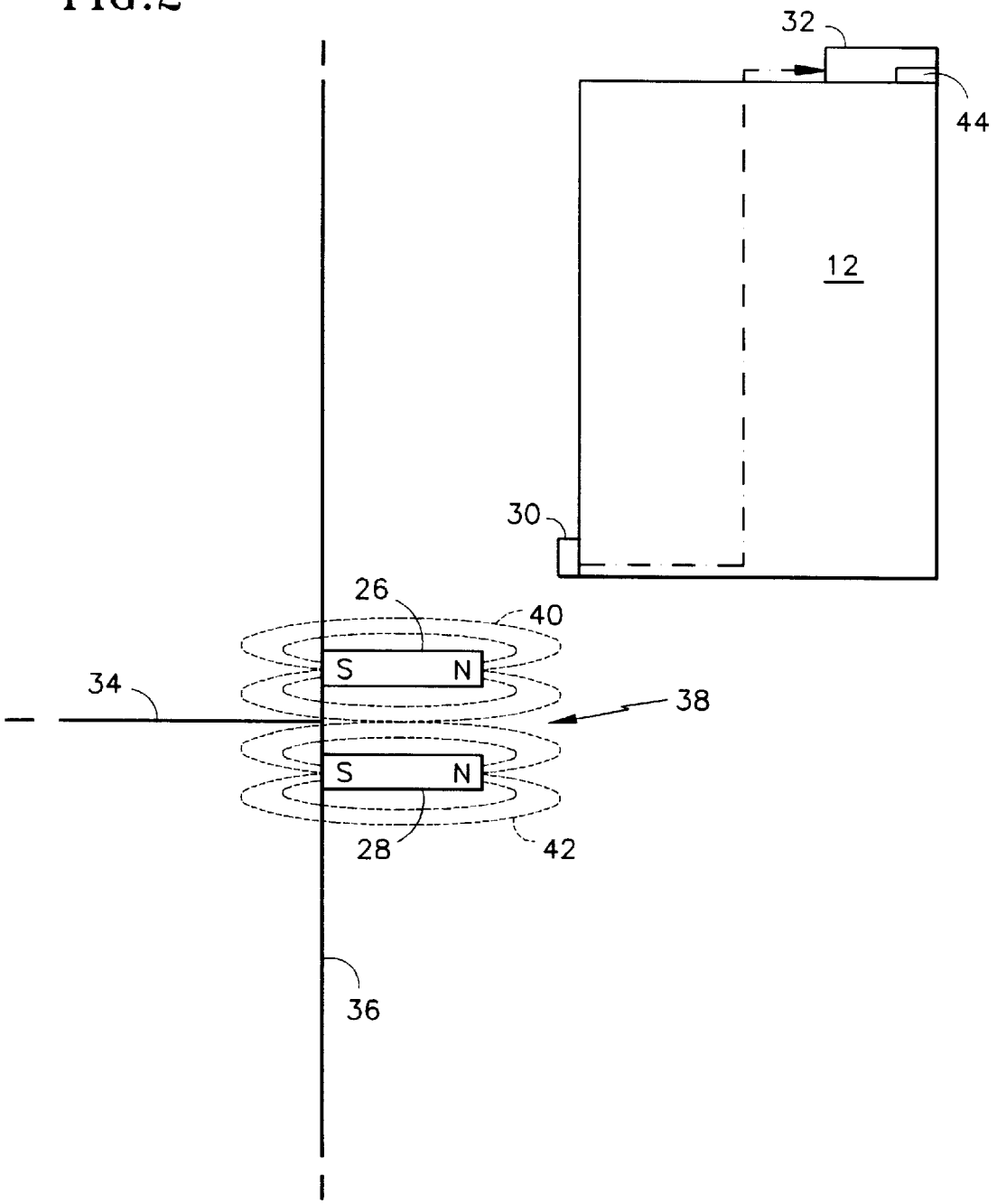
FIG. 2 is a simplified block diagram illustrating an apparatus in accordance with the present invention.

Referring to FIG. 2, an elevator position apparatus according to the present invention is used in conjunction with the elevator system 10 to accurately determine the position of the elevator car 12 in the hoistway 14. The elevator position apparatus includes a first magnet 26, a second magnet 28, a sensor 30 and a processor 32.

The first and second magnets 26, 28 each have a first magnetic pole N and a second magnetic pole S and are disposed proximate to a landing 34. The magnets 26, 28 are adjacently aligned such that the first magnetic pole N of the first magnet 26 is adjacent to the first magnetic pole N of the second magnet 28, and the second magnetic pole S of the first magnet 26 is adjacent to the second magnetic pole S of the second magnet 28. The magnets are disposed proximate to the landing 34, for example, on a hoistway wall 36. In one embodiment, the first magnet 26 is disposed in the hoistway along the longitudinal direction of elevator travel on one side of the landing 34 and the second magnet 28 is disposed in the hoistway along the longitudinal direction of elevator travel on an opposite side of the landing 34. One of ordinary skill in the art would appreciate that the magnets are disposed at a distance from the landing in accordance with a magnetic field strength of each magnet.

A minimum flux region 38 is formed by the first and second magnets 26, 28 as a result of their adjacent alignment and their respective magnetic fields 40, 42. The minimum flux 38 region is defined as the area where the magnetic fields have a minimum value as a result of a summation of the magnetic field 40 of the first magnet 26 and the magnetic field 42 of the second magnet 28. In one embodiment, the minimum flux region 38 has a magnetic field strength equal to zero. It should be understood by those skilled in the art that the minimum flux region may include a magnetic field strength not equal to zero depending on the relative strengths of each magnetic field, the position of each magnet with respect to each other, the presence of nearby magnetized material or stray magnetic fields.

The sensor 30 is a device which is capable of detecting the magnetic fields 40, 42 emitted by the magnets 26, 28; for example, a hall effect sensor. The sensor 30 provides a level signal 46 in response to detecting the magnetic fields. The level signal 46 has a detection value which is dependent on the strength of the magnetic field(s) that the sensor 30 is detecting. The sensor 30, in one embodiment, is disposed on the elevator car such that the sensor 30 detects the magnets 26, 28 as the car 12 passes the magnets 26, 28 during its travel in the longitudinal direction.

The processor 32 is used for determining if the elevator car 12 is level with respect to the landing 34 in response to the level signal 46. In one embodiment, the processor 32 comprises a memory 44 for storing data and software. The software is embedded in the memory 44 using methods known to those skilled in the art and is used to determined if the elevator car 12 is level with respect to the landing 34 as is explained below. In an alternative embodiment, the processor 32 comprises hardware for determining if the elevator car 12 is level with respect to the landing 34. The processor 32, for example, may be implemented in the elevator controller 18. The implementation of either the software or the hardware of the processor should be known to those of ordinary skill in the art in light of the instant specification.

An embodiment of the present invention operates as follows. As the elevator car 12 travels in the hoistway 14 and approaches the landing 34, the approximate position transducer provides the approximate position signal which indicates that the elevator car 12 is proximate to a particular landing. The approximate position signal is used to indicate which landing the elevator is near. For example, the approximate position signal may indicate that the particular landing is the tenth landing. As the elevator car continues to travel, the sensor detects the magnetic field of one of magnets. The detection value of the level signal varies according to the position of the sensor with respect to the magnets. Thus, the detection value varies as the elevator car 12 travels either toward, or away from, the magnets. In an alternative embodiment, the approximate position transducer is not present and thus landing information is either derived by other means or is not utilized.

The sensor 30, in response to detecting the magnetic field, provides the level signal 46 having the detection value proportionate to the strength of the detected magnetic field to the processor 32. The processor 32 allows the elevator car 12 to continue its travel until the detection value of the level signal 46 corresponds to a magnetic field strength representing the minimum flux region 32 for the particular landing. If, for example, the strength of the magnetic field is zero in the minimum flux region for landing ten, then a detection value of zero may be chosen to represent that the sensor is in the minimum flux region for landing ten. However, one skilled in the art should readily recognize that a number of various schemes can be used to scale the detection value of the level signal without departing from the spirit and scope of the present invention.

Once the level signal 46 has the detection value corresponding to the minimum flux region 38 of the particular landing, the processor 32 determines that the elevator car 12 is level with respect to the landing. In an embodiment, the detection values corresponding to the minimum flux region for each landing are stored in a look-up table in the memory 44 so that the processor 32 can compare a table value for the particular landing and the detection value of the level signal.

The table may also be used to compensate for various placement of the magnets with respect to the landing. For example, the elevator car may not be level with respect to the landing when the detection value corresponds to the minimum flux region of the particular landing. In this case, a value other than that of the one corresponding to the minimum flux region may be stored in the table for the particular landing.

Various changes to the above description may be made without departing from the spirit and scope of the present invention as would be obvious to one of ordinary skill in the art of the present invention. For example, a plurality of magnets may be disposed in the hoistway so that a higher leveling position resolution is achieved.

What is claimed is:

1. The apparatus for determining if an elevator car is level with respect to a landing in a hoistway said apparatus comprising:

a first magnet disposed proximate to the landing, the first magnet having a first magnetic pole and a second magnetic pole;

a second magnet disposed proximate to the landing, the second magnet having a first magnetic pole and a second magnetic pole;

said first magnet and said second magnet are adjacently aligned such that the first magnetic pole of said first magnet is adjacent to the first magnetic pole of said second magnet, and the second magnetic pole of said first magnet is adjacent to the second magnetic pole of said second magnet wherein a minimum flux region is formed by the first and second magnets;

a sensor disposed on the elevator car for providing a level signal in response to detecting the minimum flux region; and a processor for determining if the elevator is level with respect to the landing in response to the level signal;

wherein said processor determines that the elevator car is level with respect to the landing if a value of the level signal corresponds to a value stored in memory.

2. The apparatus for determining if the elevator car is level with respect to the landing in the hoistway as recited in claim 1 wherein said first and second magnets are disposed on a hoistway wall.

3. The apparatus for determining if the elevator car is level with respect to the landing in the hoistway as recited in claim 1 wherein said first and second magnets are disposed on opposite sides of the landing along a longitudinal direction of elevator travel.

* * * * *